United States Patent [19]

Johnson et al.

[11] Patent Number: 5,033,550

[45] Date of Patent: Jul. 23, 1991

[54] WELL PRODUCTION METHOD

[75] Inventors: Kenneth J. Johnson, Houston, Tex.; E. Alan Coats, Laurel, Miss.

[73] Assignee: Otis Engineering Corporation, Dallas, Tex.

[21] Appl. No.: 509,554

[22] Filed: Apr. 16, 1990

[51] Int. Cl.[5] ..... E21B 43/12

[52] U.S. Cl. ..... 166/372; 166/68; 166/117.5; 166/105; 166/370

[58] Field of Search ..... 166/370, 372, 117.5, 166/313, 105, 68, 97.5, 242; 137/155; 417/172, 108-111, 115-117

[56] References Cited

U.S. PATENT DOCUMENTS

| | | | |
|---|---|---|---|
| 425,624 | 4/1890 | O'Neil | 417/172 X |
| 443,513 | 12/1890 | Geiser | 166/105 |
| 528,449 | 10/1894 | Staley | 166/68 X |
| 1,547,197 | 7/1925 | Arbon | 166/370 |
| 2,080,624 | 5/1937 | McMahon | 417/172 X |
| 3,050,121 | 8/1962 | Garrett et al. | 166/372 X |
| 3,116,781 | 1/1964 | Rugeley et al. | 166/77 X |
| 3,373,816 | 3/1968 | Cochran | 166/298 |
| 3,731,742 | 5/1973 | Sizer et al. | 166/53 X |
| 4,171,016 | 10/1979 | Kempton | 166/68 |
| 4,579,511 | 4/1986 | Burns | 417/109 |
| 4,682,656 | 7/1987 | Waters | 166/372 |
| 4,711,306 | 12/1987 | Bobo | 166/372 |
| 4,791,990 | 12/1988 | Amani | 166/372 X |

OTHER PUBLICATIONS

The article entitled, "Venturi Jet Tool Unloads Gas Wells", World Oil, Nov. 1979, p. 79.

*Primary Examiner*—Hoang C. Dang
*Attorney, Agent, or Firm*—Johnson & Gibbs

[57] ABSTRACT

Apparatus and method for the production of methane gas from coalbed methane wells. The apparatus includes a production string having spaced side pocket mandrels supporting gas lift valves and defining with a well casing an annulus in the well running continuously without a packer from a coalbed seam to the wellhead and a lift gas injection line extending through the annulus along the production tubing string and connected into the side pocket mandrel for injecting lift gas into the production tubing string to produce well fluids and lift gas in the tubing string while simultaneously producing coalbed methane gas up the annulus. The method of the invention includes the steps of injecting lift gas through a lift gas injection line to a gas lift valve in a well production tubing string and producing well fluids along with lift gas up the tubing string while producing coalbed methane gas up the annulus.

6 Claims, 3 Drawing Sheets

WELL PRODUCTION METHOD

This invention relates to systems and methods for the production of well fluids from earth formations and more particularly relates to systems and methods for the production of coalbed methane wells.

BACKGROUND OF THE INVENTION

For many years coal has been mined from the earth for use as an energy source, i.e. the production of heat by the burning of the coal. A constant obstacle encountered in coal mining has been large volumes of water. A constant danger inherent in coal mining both to equipment and to men has been methane gas which is poisonous and explosive. The methane gas, unlike natural gas in place in an earth formation, comprises methane gas molecules attached to the coal which are released from the coal when the ambient pressure at the gas molecules is released to a predetermined level which varies depending upon the particular formation. For example, the methane gas is released from coal in the San Juan Basin near Farmington, N. Mex., at pressures from 80 to 160 psi. In distinct contrast, in the Black Warrior Basin near Tuscaloosa, Ala., the release pressure, desorption pressure, is about 5 to 10 psi. The depletion of oil and natural gas in recent years, particularly in the United States, has made coalbed methane gas an especially attractive secondary source of energy, particularly where the gas can be recovered economically. Two principal components of coalbeds are methane gas and formation water. The hydrostatic pressure in water in a coalbed at the site of attachment of the methane gas molecules to the coal surface, if sufficiently elevated, prevents the methane gas from detaching from the coal surface and flowing up a well penetrating a coalbed. Thus, the principal problem in the production of coalbed methane wells is the de-watering of the wells sufficiently to lower the hydrostatic pressure to a level at which the methane gas will flow to the surface in the wells. At the present time, coalbed methane gas has been produced only from the Black Warrior and San Juan Basins. The production and estimated reserves of coalbed methane gas in the United States are dramatic. The net production has been over four billion cubic meters of methane gas and the recoverable reserves in these two basins is estimated to be approximately 1.1 trillion cubic meters. The estimated reserves in the United States are believed to be in excess of 4 times the known reserves of other forms of natural gas, which is approximately 11.5 trillion cubic meters. In addition to the significant known reserves of coalbed methane gas, coalbed methane gas production is generally a low volume and low pressure situation which does not require special pressure equipment to either produce or service the wells. The wells generally are relatively shallow and once they are de-watered they produce with relatively few major maintenance problems. They typically will produce for 12 to 15 years. Significant reserves of methane gas are believed also to exist in Canada, as well as Australia, China, France, Holland and New Zealand.

Until the development of the present invention, coalbed methane wells have been de-watered to the extent necessary for the release and production of the methane gas by means of artificial lift. In the Black Warrior Basin the water has been produced from the wells using either rod or "Moyno" pumps. The wells have generally been drilled to a depth of 1,250 feet with some of the more recent wells reaching depths up to 6,000 feet. The water has been produced inside tubing while the methane gas flowed up the well annulus between the tubing and the well casing. Production in such wells has ranged from 50–1000 barrels of water per day, generally averaging 300–350. The wells have generally required from 3–12 months to de-water sufficiently for methane gas production. It has been necessary to lower the flowing bottom hole pressure across the coal seams producing the methane gas to a level of approximately 5–10 psi.

As an alternative method of de-watering wells in the Black Warrior Basin, in recent years, gas lift equipment and methods have been employed. One such method is known as "single point air injection". Air is injected down a tubing string from which the air is discharged at the bottom of well with air and water returning to the surface in the well annulus. While this method not only removes water from the well, it also has the advantage of removing frac sand and coal fines from the wellbore prior to completion of the well. There are, however, a number of problems and inefficiencies associate with this air injection method. A rig must be maintained at the wellsite until rods for a pumper installed. The air compressor required to provide sufficient air to bring the water to the surface is costly. There are no means to effectively monitor either gas production or bottom hole pressure. The flowing of the air through the tubing and the casing is extremely corrosive to the tubing and casing, and if the procedure is carried out for any prolonged period of time, they deteriorate beyond repair. When such deterioration occurs, the wells cannot be effectively re-watered prior to being placed on a rod pump. Thus, the air injection has not proven to be satisfactory for water removal in coalbed methane wells.

A second gas lift technique which has been used employs a conventional casing flow gas lift installation, which includes a tubing string including a side pocket mandrel fitted with gas lift valves disposed within an inner casing which is spaced within an outer well casing. Lift gas flows down the tubing and outwardly from the tubing through the gas lift valves into the inner casing and back to the surface through the inner annulus. The injected gas and well fluids including water are produced up the inner or secondary annulus. The methane gas is produced up the outer or secondary annulus. While this basically conventional gas lift system and method will produce a substantial amount of water, it has a number of shortcomings. As a well is unloaded, the production initially passes through the ported section of the unloading valve. The production fluid quite often contains coal fines which damages the stem and seat of the valves. As the well is unloaded to the next operating valve, a multipoint injection failure will occur because of destruction of the first valve. This failure will sharply curtail fluid lift efficiency and cause excessive and wasteful consumption of lift gas. Further, as the valves are a permanent part of the production string they cannot be retrieved and repaired without pulling the tubing string and performing a completion workover. In comparison to the use of a rod pump, this is not an economically viable alternative. And additionally, such a well installation to provide both the secondary and primary annulus is more costly than conventional rod or the usual gas lift installation.

A system and method disclosed in U.S. Pat. No. 4,509,599 issued Apr. 9, 1985 removes formation water from a well where low bottom hole pressures exist.

Such system and method, however, require apparatus which could be more difficult, expensive, and time consuming to install and service than the present invention.

Thus, while the air injection method and the gas lift method utilizing primary and secondary annuli both will produce large volumes of water, they are neither a truly economical and effective way of producing coalbed methane wells.

Additional problems which have been encountered and which cannot be effectively addressed by the present available well installations and methods is that in locations such as the Black Warrior Basin a multiplicity of coal seams can be produced through a single well. For example, the number of coal seams penetrated by a single well may range from on the order of 3 to 8 vertically spaced apart anywhere from 30 or 40 feet to 200 feet. Such coal seams may start as deep as 500 to 1000 feet. Some of the coalbed seams, particularly in the Black Warrior Basin, may be only 1 to 5 feet thick. Under such circumstances, a packer cannot be placed in a well at 500 feet and be able to lower the bottom hole pressure and gas lift above the packer. The water has to be removed essentially to the total depth of the well so that there is no more than a 30 or 40 foot hydrostatic head on the coal seam formation. The multiplicity of coal seams penetrated by a well together with the economics of well installation preclude the use of packers in a well between the producing string and well casing closing off the annulus at each of the packers.

SUMMARY OF THE INVENTION

It is an object of the invention to provide a new and improved well installation for the production of coalbed methane wells.

It is another object of the invention to provide a new and improved well installation for the de-watering of coalbed methane wells.

It is another object of the invention to provide a new and improved method of producing coalbed methane wells.

It is a further object of the invention to provide a new and improved method of de-watering coalbed methane wells.

It is further object of the invention to provide a well installation for and a method of producing coalbed methane wells which is more economical than existing installations and methods.

It is a still further object of the invention to provide a well installation for and a method of de-watering coalbed methane wells which effectively lowers the flowing bottom hole pressure to a level below that achieved by most of the existing installations and methods.

It is a still further object of the invention to provide a well installation for and a method of producing coalbed methane wells which removes water from the wells at a more rapid rate and in a shorter period of time than achieved in presently known installations and methods.

It is a still further object of the invention to provide a well installation for and a method of producing coalbed methane wells which avoids the destructive action of sand and coal fines on the well production equipment.

It is a still further object of the invention to provide a well installation for and a method of producing coalbed methane wells utilizing gas lift valves which may be installed, retrieved, and changed without the usual expense and time of a workover of the well.

It is a further object of the invention to provide a well installation and method for the production of coalbed methane wells which minimizes gas consumption during and lifting life of the well by the changing of the gas lift valves as needed during the well history.

It is another object of the invention to provide a well installation for and method of producing coalbed methane wells wherein water and injected gas are produced up the tubing and the coalbed methane gas is produced up the annulus.

It is another object of the invention to provide a well installation for and method of producing coalbed methane wells wherein the bottom hole or desorption pressure is reduced to approximately 5 to 10 psi.

It is another object of the invention to provide a well installation for and method of producing coalbed methane wells which utilizes side pocket mandrels along a fully open tubing accepting wireline retrievable gas lift valves permitting well servicing throughout the life of the well without necessitating a well workover.

It is a further object of the invention to provide a well installation for and method of producing coalbed methane wells wherein reliable bottom hole pressure surveys may be obtained.

It is a still further object of the invention to provide a well installation for and method of producing coalbed methane wells using gas lift valves which are removed from the flow pattern of the well production, and thus, are not affected by bottom conditions which are inherently detrimental to pump type installations.

It is a further object of the invention to provide a well installation for and method of producing coalbed methane wells wherein the rate of fluid production is easily changed by adjusting the gas volume injected or by reducing injection pressure.

It is another object of the invention to provide a well installation for and method of producing coalbed methane wells wherein fluid may be produced intermittently after a fluid production rate is lowered below a predetermined desirable level.

In accordance with one aspect of the invention, there is provided a well installation for the production of coalbed methane wells including a well extending from a surface end through at least one methane gas producing coalbed seam, a wellhead mounted on the surface end of the well, a tubing string supported in the well from the wellhead extending to the gas producing coal seam, a side pocket mandrel secured in the tubing string for releasably supporting a gas lift valve along the tubing string, the outer wall of the tubing string being spaced inwardly from the wall of the well bore defining an open annulus in the well bore from below the coalbed seam upwardly to the wellhead, a gas lift valve releasably mounted in the side pocket mandrel for controlling flow of lift gas into the tubing string, and a lift gas injection tubing extending through the wellhead downwardly through the well annulus to the side pocket mandrel for flow of lift gas from exterior of the wellhead downwardly through and isolated from the well annulus to the gas lift valve in the side pocket mandrel. In accordance with another aspect of the invention, there is provided a method of producing a coalbed methane well including the steps of flowing lift gas into a wellhead and downwardly through the annulus of a well in a tubing string isolating the lift gas from the well annulus, through a gas lift valve mounted along a production tubing string in the well extending to a methane gas producing coalbed seam, the lift gas being introduced at a pressure and flow rate sufficient to raise fluid inlcuding particularly water in the production tubing string to the surface end of the well and outwardly from the well through the wellhead, injecting the lift gas until sufficient water is removed from the well to reduce the pressure in the well at the coalbed seam to a level sufficient to release methane gas from the coalbed seam into the well annulus and flowing the methane gas through the well annulus to the surface and outwardly from the well through the wellhead while simultaneously flowing injected lift gas and well fluids including water through the tubing string to the surface and from the well through the wellhead.

DESCRIPTION OF THE PREFERRED EMBODIMENTS

Figure 1:
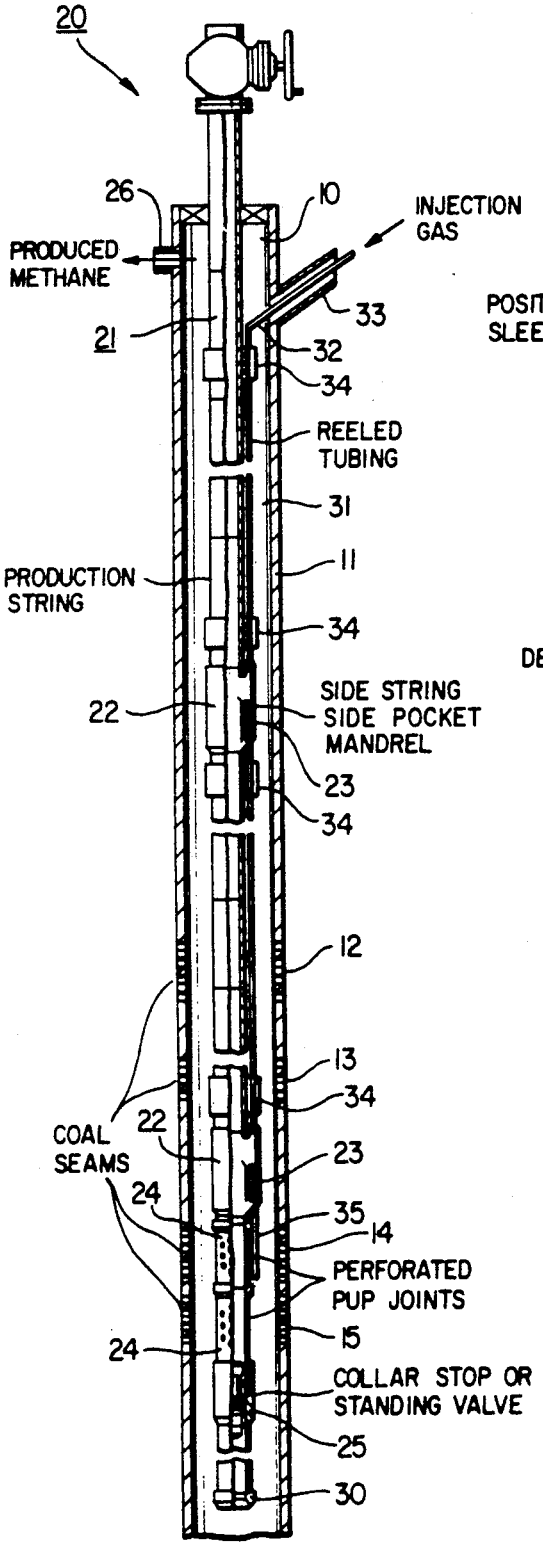
FIG. 1 is a schematic view in section and elevation of a coalbed methane well installation in accordance with the invention.

One typical well installation embodying the features of the invention is illustrated in FIG. 1. A well 10 penetrating an earth formation has a well casing 11 which is perforated at 12, 13, 14, and 15 leading to a plurality of coalbed seams, not shown. Methane gas is present in each of the coalbed seams and may be released from the coal in each of the seams and produced into the well casing through the perforations. The well is provided with a wellhead 20 of standard construction having the usual required fittings and valves, not specifically illustrated, for the injection and production of the fluids involved in the process of the invention. A production tubing string 21 is connected into and supported from the wellhead 20 in the well 10 extending downwardly to the vicinity of or below the several coalbed seams from which methane gas will be produced from the well. Standard side pocket mandrels 22 are connected in the tubing string 21 appropriately spaced along the length of the tubing string, each supporting a gas lift valve 23 for control of the admission of lift gas into the tubing string in accordance with the invention. The lower end portion of the tubing string 21 includes perforated pup joints 24 for admission of the well fluids into the bore of the tubing string. A landing nipple 25 and re-entry guide 30 are connected into the lower end of the tubing string below the pup joints. The landing nipple 25 provides for the installation various production tools such as a standing valve.

Figure 2:
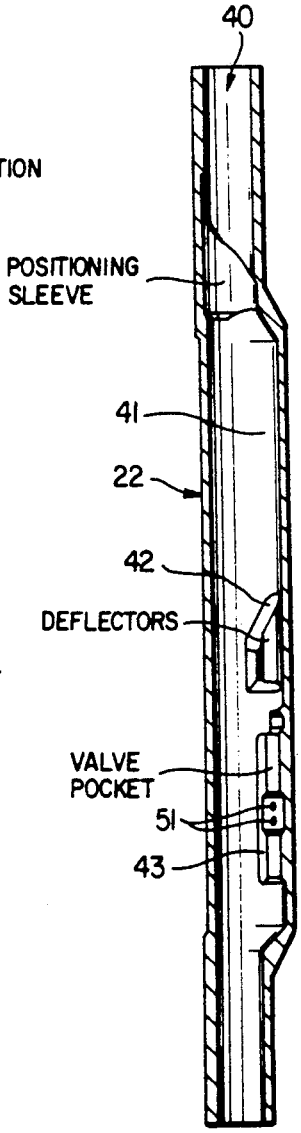
FIG. 2 is a longitudinal view in section and elevation of one of the side pocket mandrels in the well system of FIG. 1.
Figure 3:
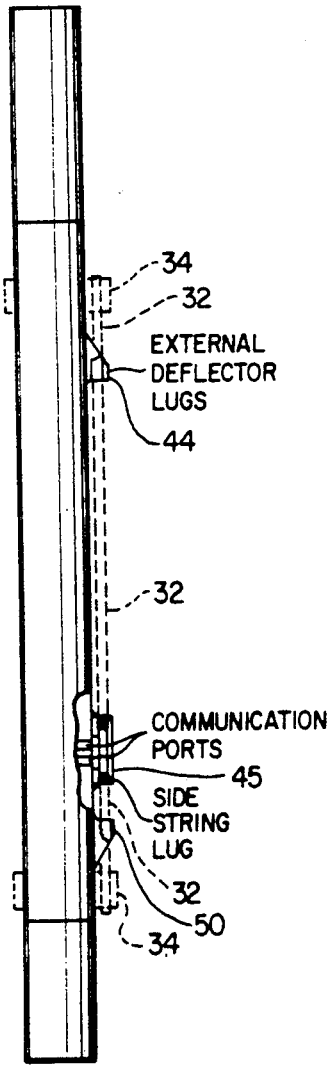
FIG. 3 is a longitudinal view in section and elevation of the side pocket mandrel of FIG. 2 seen along a plane 90 degrees from that of FIG. 2 illustrating side lugs for the support of the lift gas supply line and side pocket mandrel lugs for mounting the lift gas supply line along the side pocket mandrel.
Figure 7:
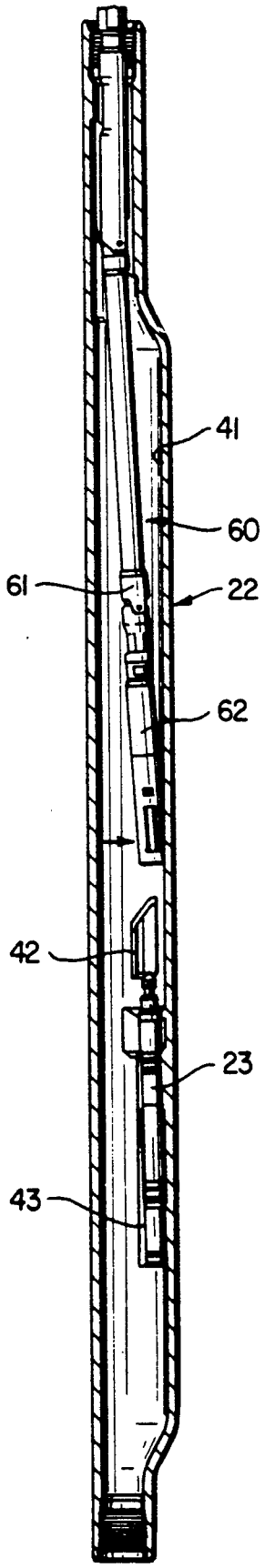
FIG. 7 is an enlarged side view in section and elevation showing one of the side pocket mandrels of the well system of FIG. 1 with a gas lift valve in place and a lower end portion of a wireline tool string used for the installation and retrievable of the gas lift valve at a position immediately after installation or before retrievable.

A suitable side pocket mandrel 22, as illustrated in FIGS. 2, 3, and 7, is shown in the Otis Engineering Corporation catalog entitled, OTIS PRODUCTS AND SERVICES OEC5516, published in 1989, at page 210. Typical gas lift valves 23 which may be used, depending upon the requirements of the particular well, are illustrated at pages 216 and 217 of the Otis Engineering Corporation catalog, supra. The tubing string 21 is concentrically positioned within the well 10 defining an annulus 31 around the tubing string within the casing 11 for the production of methane gas from the coalbed seams. An injection gas tubing string 32 enters the wellhead through a side fitting 33 and is supported in the well annulus 31 along the production tubing string 21 connected into the side pocket mandrels 22 for supply of lift gas to each of the gas lift valves in the mandrels. Longitudinally spaced tubing clamps 34 couple the injection gas tubing string to the production tubing string to relieve the various sections of the injection gas tubing string of loads at the threads where such sections are connected into side fittings of the side pocket mandrels. A debris trap 35 is connected into the lower end of the injection tubing string 32 below the bottom side pocket mandrel 22. The debris trap is provided to collect debris in the injection gas to aid in protecting the gas lift valves from damage from such debris.

Figure 4:
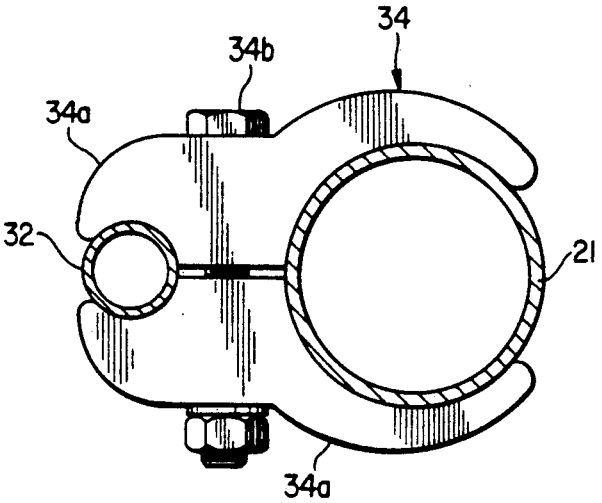
FIG. 4 is a enlarged view in section showing a pipe clamp for connecting the lift gas supply line to the tubing string.
Figure 5:
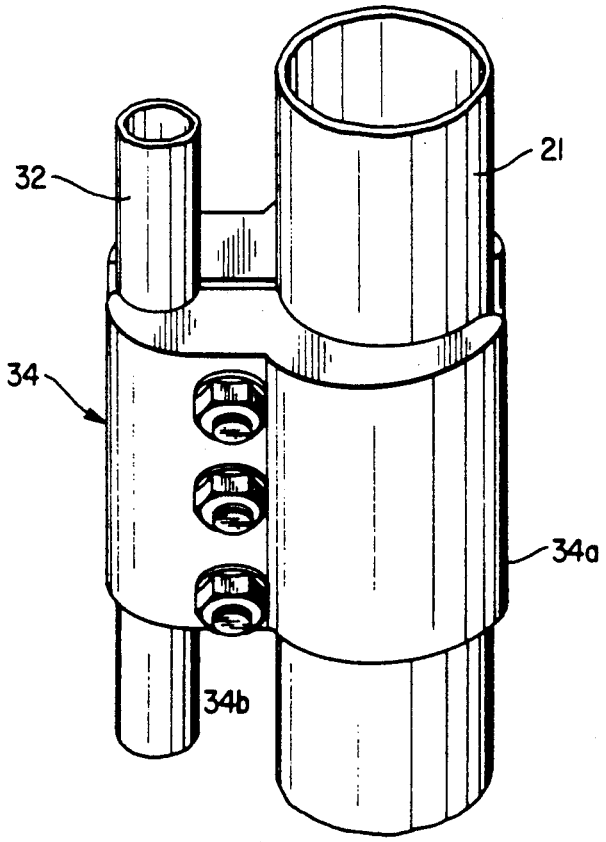
FIG. 5 is an enlarged view in perspective of the pipe clamp with the tubing string and lift gas supply shown in FIG. 4.

A specific commercially available design of the side pocket mandrels 22 is shown in FIGS. 2 and 3. As seen in FIG. 2 the side pocket mandrel has a bore 40 communicating with the tubing connected into the upper and lower ends of the side pocket mandrel forming the production tubing string 21. The bore 40 is enlarged along a section 41 which is provided with an internal deflector 42 and a gas lift valve pocket 43, both fittings being laterally displaced from the main bore through the side pocket mandrel so that wireline tool strings may readily operate through the mandrel for the various well servicing functions which may be required. The valve pocket 43 holds the gas lift valve 23 which may be installed and/or removed as illustrated in FIG. 7 and described hereinafter. The side pocket mandrel 22 has external body fittings 44, 45, and 50, FIG. 3, for connection of the lift gas injection tubing string 32 to the side pocket mandrel and into the mandrel for conducting lift gas to gas lift valve in the mandrel. It will be apparent in FIG. 3 that the lift gas tubing string 32 comprises various tubing sections connected with the side pocket mandrel. The upper section of the tubing string 32, as seen in FIG. 3, passes through the side fitting 44 connecting into threads in the upper end of the side fitting 45. The lower section of the lift gas tubing string 32 shown in FIG. 3, is threaded at an upper end into the lower end of the side fitting 45. The bore of the side fitting 45 communicates through ports 51 with a gas lift valve in the valve pocket 43 of the side pocket mandrel. The tubing clamps 34, illustrated schematically by phantom lines in FIG. 3, are shown in detail in FIGS. 4 and 5. As seen, each of the tubing clamps is formed by clamp half-sections **34*a* secured together by bolt assemblies 34*b* on opposite sides of the production tubing string 21 and the lift gas injection string 32, clamping the lift gas injection string to the production string. The use of the tubing clamps prevents longitudinal loads on the injection gas tubing string from being imposed directly on the threaded connections at the ends of the tubing string sections secured into the side pocket mandrel side fittings 45**.

Figure 6:
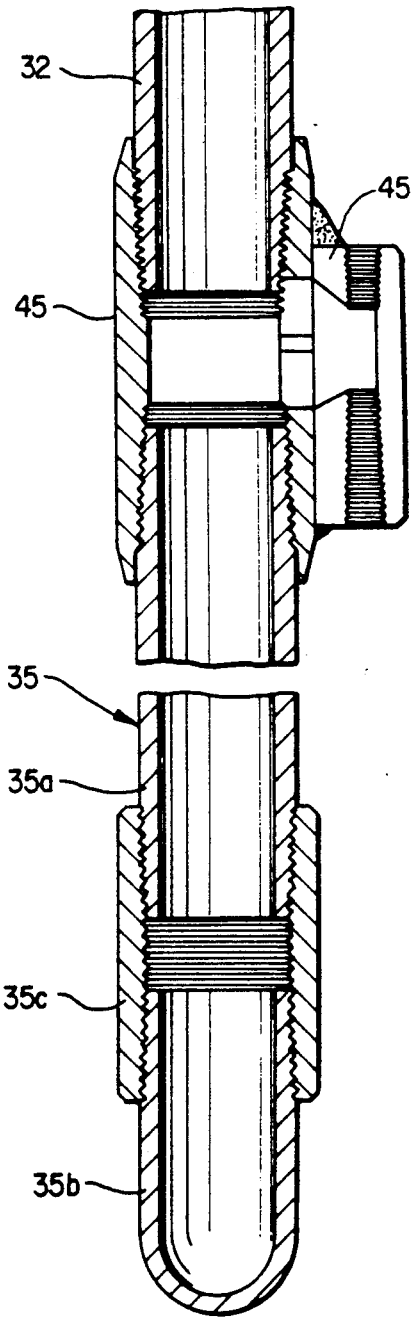
FIG. 6 is a fragmentary view in section showing the lower end of the lift gas supply line and a debris trap connected with the lower most side pocket mandrel.

One form of construction of the debris trap 35 is illustrated in FIG. 6 showing the back side of the mandrel fitting in terms of FIGS. 1 and 3. A pup joint 35*a* which may, for example, be about six feet long, is threaded along an upper end into the lower end of the side fitting 45 in the bottom side pocket mandrel 22. A bull plug 35*b* is connected by coupling 35*c* to the lower end of the pup joint closing the lower end of the debris trap.

In the various embodiments of the well installation of the invention, the gas lift valves 23 in the side pocket mandrels 22, other than the bottom mandrel, are Otis RS gas lift valves, as illustrated at page 216 of the Otis Engineering Corporation catalog, supra. In a form of the well installation where the water production will be continuous, the bottom gas lift valve is an Otis RCC type valve illustrated at page 218 of the Otis Engineering Corporation catalog, supra. In another form of the well installation of the invention where water is removed intermittently after initially unloading the well, the bottom lift valve is an Otis RSF type which responds to the liquid level in the production tubing string, illustrated at page 217 of the Otis Engineering Corporation catalog, supra.

Particularly important features of the well installations of the invention are the side pocket mandrel 22 and the gas lift valves 23 which materially reduce maintenance cost and time through the use of conventional wireline service methods and equipment. Referring to FIG. 7, the gas lift valves 23 are installed and removed using a wireline tool string 60 including a positioning tool 61 which may be connected to either a running tool for installing the gas lift valve in the side pocket mandrel or a pulling tool for removing the gas lift valve from the mandrel and the production string 21. In FIG. 7 the tool string includes a pulling tool 62 which is illustrated in the wireline tool string at a position immediately prior to engaging the gas lift valve 23 for removal of the gas lift valve from the side pocket mandrel. The positioning tool includes a kickover tool which allows the gas lift valve and the tool supporting the gas lift valve, such as the pulling tool 62, to be moved laterally to the side for insertion and removal of the gas lift valve in the side pocket mandrel pocket 43. Typical available wireline equipment and services are illustrated in the Otis Engineering Corporation catalog, supra, at page 251 et seq, and sequential operation of a typical positioning tool with a kickover tool is illustrated at page 212 of the catalog. Such equipment and services are standard in the oil and gas industry. The use of the side pocket mandrels having a deviated pocket leaving the bore through the mandrel open provides an open passage from the wellhead 20 to the lower end of the producation tubing string 21 so that a wide variety of well servicing operations are readily carried out in the production tubing string without pulling the tubing string or the valves from the well. Any one of the gas lift valves may be readily removed, serviced, and replaced without pulling the tubing string or disturbing the other gas lift valves in the well installation. Well cleaning operations for removal of such material as coal fines and various reservoir debris are easily carried out through the production tubing string.

A well is drilled into coalbed formations and the well is completed using a well installation 20 embodying the features of the invention employing industry standard well drilling equipment and techniques and installation equipment and techniques. The well is drilled through the coalbed seams desired to be produced. Generally, the wells will ranged from 1000 feet to 2500 feet deep, though some new wells now being drilled for coalbed methane production reach depths of up to 6000 feet. The number of coalbed seams penetrated by a well may range from one to a significant number, such as eight or ten and spacing between such seams may be from one to two thousand feet, for example. The well is completed with a casing 11 which is perforated such for example as at 12, 13, 14, and 15, such perforations opening into the coalbed seam or seams penetrated by the well. The depth of the well may range from as deep as the lowest coalbed seam desired to be produced, or alternatively, if economics permit the well may be drilled deeper to provide a sump or rat hole below the lowest coalbed seam of a depth as much as sixty to eighty feet or more. Such a rat hole will permit the collection of formation water below the lower most producing seam and thereafter the intermittant production of the water provided the well installation is equipped with the appropriate gas lift valves.

Once the well has been drilled and cased, the well is completed with the well installation 20 as illustrated in FIG. 1. The lower end of the production tubing 21 may simply open into the well, or alternatively, the well may include the perforated pup joints 24, the landing nipple 25, and the wireline guide member 30. The nipple 25 provides the means for installation of the well tool such as a standing valve which is desirable in certain well completions. The standard procedures and equipment are used for running the production tubing string 21 into the well. The side pocket mandrels 22 are connected into the production string 21 as the string is run into the well at spacings which are appropriate for the particular gas lift operation to be carried out in the well to remove the formation water. The gas lift valves 23 normally are installed in the side pockets of the side pocket mandrels as the production string including the mandrels is run into the well. Also, as the production tubing string with the mandrels is assembled and lowered into the well, the gas lift valve injection line 32 is assembled on the producation string and connected into the side pocket mandrels with the debris trap 35 being mounted on the lowermost side pocket mandrel extending below the mandrel to collect debris which may be present in the injection gas. To relieve the load on the threaded connections of the line 32 into the side pocket mandrels, the tubing clamps 34 are connected between the tubing 32 and the production tubing string above and below the side pocket mandrels. A form of tubing which may comprise the lift gas injection line 32 and which is especially appropriate for the installation of the invention in that it is very economical and can readily handle the pressures involved is what is known in the industry as the "coiled tubing". Such coiled tubing comes in a continuous form which may be of a length sufficient to extend from the wellhead to the side pocket mandrels without intervening connections. The coil tubing is conveniently stored on a reel, not shown, and introduced into the well from the reel as the production tubing 21 is run into the well. Use of such coiled tubing and apparatus for the installation of the tubing is illustrated in U.S. Pat. No. 3,116,781, issued Jan. 7, 1964 to R. S. Rugely et al. and U.S. Pat. No. 3,373,816, issued Mar. 19, 1968 to C. B. Cochran. After the installation of the production tubing 21 with the lift gas injection line 32 is completed and appropriately supported from and connected to the wellhead 20, the coil tubing exits through the wellhead in the side fitting 33. The wellhead 20 with side fitting 33 is made up of available wellhead parts resembling, for example, the forms of wellheads illustrated in and described in U.S. Pat. No. 3,731,742, issued May 8, 1973 to Phillip S. Sizer and Albert W. Carroll and assigned to Otis Engineering Corporation. Not only is the coiled tubing a particularly economically attractive way of providing the lift gas injection line, such coiled tubing can readily be removed from the well and reused in other wells.

During the completion of a coalbed methane well employing the installation 20, embodying the features of the invention, the particular gas lift valves installed in the side pocket mandrels will depend upon the particular production methods intended to be followed in the well. For example, if well conditions are such that once the water is removed sufficiently for methane production and continuous water removal is desired or necessary thereafter, the valve in the bottom mandrel will be an RCC type as previously described and illustrated in the Otis Engineering Corporation catalog, while the valves in the upper side pocket mandrels are RS type valves, which may also be referred to as "unloading valves". If, on the other hand, the well is to be produced intermittently after the water level is lowered to the point where methane gas production is obtained, such for example if the water production is reduced to from 50–100 barrels per day, the well may be completed for intermittent water production once the water level has been lowered to the level of or below the bottom gas lift valve. Under such circumstances the RS type valves are used in the upper side pocket mandrels while the bottom mandrel is fitted with an RSF type gas lift valve. The RSF type valve is liquid responsive opening to permit lift gas injection when a predetermined liquid pressure is applied at the valve in the production tubing string. Thus, as the liquid level rises in the well, such as, for example, if the well includes a rat hole sump, when the liquid level is at a sufficient depth at the RSF valve, the valve opens admitting lift gas to displace the water to the surface in the production tubing string. This technique permits automatic intermittent operation of the well once the water has been reduced to a sufficient level that methane gas production is obtained in the well. When a well is so equipped for intermittent production, it is further desirable to use a suitable standing valve in the landing nipple 25 which includes a check valve allowing upflow of liquid. In the event that the standing valve is used, the perforated pup joints 24 would not be employed. The use of the standing valve permits the fluid to rise in the production tubing string and not to flow back into the well. It will be evident that the perforated pup joints would not be employed because with such perforations the well fluid would simply flow back into the well from above the standing valve.

A particularly important feature of the invention is that the well is completed with the installation 20 without the use of any packers between the production tubing and casing. The spacing between and the number of coalbed seams which may be produced through the well make the use of packers extremely undesirable from both an economic and a procedural standpoint. Thus, a special feature of the invention is the uninterrupted, continuous annulus 10 between the production tubing and the well casing for flow of methane gas in the annulus from the lowermost producing coalbed seam to the side outlet in the wellhead. In typical gas lift well completions, the lift gas is introduced into the well to the gas lift valves through an open annulus. In contrast, in accordance with the present invention, the annulus is used for the production of the methane gas. It will be apparent that lift gas could not be injected down the annulus to impose a pressure on the coal seams which would prevent the methane gas from detaching from the coal and enter into and flowing to the wellhead through the annulus.

The RCC type operating valve employed in the bottom mandrel includes a check valve which allows the tubing to be isolated from the annulus when lift gas is not being injected into the production tubing.

Standard gas lift engineering considerations and calculations are employed in the design of the completion system 20. System parameters that are considered include: optimum production capabilities; gas injection requirements (volume and pressure); and valve spacings and settings. Designing the installation for existing wells which have been de-watered by pumps provides a significant amount of information all of which is not normally available in new wells. Information which has been found to be pertinent to such design are:

1. Static Fluid Level (SFL)
2. Flowing Fluid Level (FFL)
3. Flowing Wellhead Pressure (Pwh)
4. Daily Production Rate (Qf)
5. Flowing Wellhead Temperature (Twh)
6. Bottomhole Temperature (BHT)
7. Daily Gas Production Rate (Qg)
8. Vertical Well Depth
9. Total Well Depth
10. Tubing Size
11. Casing Size and Weight to Depth
12. Perforation Depth
13. Maximum Available Injection Pressure (Pinj)
14. Distance from Separator and Line Size
15. Separator Pressure (P sep)
16. Specific Gravity Gas (SGG)
17. Specific Gravity Water (SGW)
18. Allowable Gas Injection Rate.

This information is used to calculate the optimum production rates that might be expected from a well. The final computed output will detail the fluid production capacity of the well, the volume of gas required to lift the fluid at a specific rate, and the injection pressure at depth for each rate. When analyzing the potential use of lift gas, the well operator will need to consider the surface injection line. Depending on the distance from the well to the compressor which compresses the gas to be injected into the well, economics could rule out the use of gas lift. The economic impact can, however, be minimized by using a surface string of coiled tubing. Once the rate of injection is determined, along with the elevation, distance from, and capacity of the compressor, both the size of the line and the compressor discharge requirements can be determined. When using the coiled tubing, the expense of laying the line is minimal, as the operator simply uncoils the tubing from a spool in much the same manner as presently used to lay plastic flow lines.

In each embodiment of the method of the invention, lift gas is directed into the injection line 32 from a compressor, not shown, and downwardly in the injection line to the gas lift valves in the side pocket mandrels 22. The gas is admitted from the line 32 through the gas lift valves into the production tubing 21 where the gas mixes with and displaces the well fluids, primarily the formation water, upwardly in the production tubing string and outwardly through the wellhead to a separator, not shown, where the water is separated from the lift gas and disposed of and the lift gas is returned to the compressor system for reinjection into the well. During the initial production stages, large volumes of coal fines and frac sand used to fracture the coalbed seams is produced through the production tubing 21. In accordance with well known gas lift processes, water in the production tubing is produced or unloaded until the bottom gas lift valve is reached. Where, in some prior art processes using pumps, the production rate may be approximately 360 barrels per day, assuming substantially the same well conditions, the present invention as produced has much 1000 barrels per day. The water production by injecting the lift gas through the upper or unloading gas lift valves continues until sufficient water has been produced from the well to draw the flowing bottom hole pressure down to a predetermined "desorption" pressure which allows the methane gas in the coal to release from the coal face and pass upwardly in the well. In a formation such as the Black Warrior Basin, the desorption pressure may be only 5–10 psi. Since the lift gas is introduced through the injection gas line 32 isolated from the annulus 10, the pressure in the injection gas is not imposed on the fluids in the annulus and when the water is sufficiently removed to reduce the bottom hole pressure to the desorption level, the methane gas is released from the coal seams opening into the well and the methane gas passes upwardly in the annulus and then out through a side connection 26 in the wellhead communicating with the annulus. The open annulus in the well from the lowermost coalbed seam producing to the wellhead allows the gas to freely flow to wellhead. When in those wells where after the desorption pressure has been reached at the producing coalbed seams, and water production still exceeds about 100 barrels per day, the well installation includes an RCC type gas lift valve admitting a continuous flow of lift gas into the production tubing string to provide continuous production of the water from the well. In those wells where the water production after the desorption pressure is reached the water production is below about 100 barrels per day, the bottom gas lift valve is of the RSF type which operates in response to the hydrostatic pressure in the tubing string at the valve. The valve, thus, allows gas injection only above a predetermined tubing pressure. Gas injection is shut off by the valve once the bottom hole pressure is reduced below that predetermined point. The well, thus, produces intermittently and effectively dictates its own injection requirements after the operator has made the initial settings of the valves. Thus, at these lower water production rates the water production will be intermittent while maintaining the desorption pressure to permit the methane gas to flow from the coalbed seams. The methane gas exits from the wellhead through the fitting 26 and passes to sales facilities where the gas may be distributed to normal sales channels. The injection gas, of course, is separated from the water and reinjected for further water production.

As the gas lift valves are moved from the path of fluid flow, they are not affected by bottomhole conditions that are inherently detrimental to pump type installations. This reduces concerns associated with frac sand, coal fines, calcium carbonates, and tubing wear associated with sucker rods.

The rate of fluid production can be changed at the surface by simply adjusting the gas volume injected or by reducing the injection pressure through the use of an adjustable choke.

Where in some formations such as the San Juan Basin the desorption pressure is from about 80 to 160 psi, in contrast the desorption pressure in formations such as in the Black Warrior Basin the desportion pressure is as low as 5 to 10 psi which can be effectively reached with the methods of the present invention.

In contract with the prior art practices for removing water in coalbed methane wells, the embodiment of the present invention offer the following benefits:

1. An economic means to de-water coalbed methane wells.
2. An effective means to monitor the performance of the well.
3. An effective means to provide downhole maintenance with a minimum amount of productive downtime.
4. An effective means to optimize operator rig time by eliminating pump related workover duties.
5. An effective means to minimize gas consumption throughout the lifting life of the well, as different valves can be installed, retrieved or changed, as circumstances dictate.
6. Allows the water to be produced up the tubing without affecting the gas production up the annulus.
7. Provides the means to target wells and estimate gas injection requirements.

In addition to being able to more efficiently reach a low desorption pressures, the methods of the invention provide means for reducing the de-watering time several fold in coalbed mathane wells.

What is claimed is:

1. A method of producing methane gas from a coalbed comprising the steps of:

drilling a well into an earth formation to a depth penetrating a coalbed seam;

setting a casing in said well extending through said coalbed seam;

perforating said casing at said coalbed seam;

installing a production tubing string in said well casing, said string extending in spaced relation in said casing to said coalbed seam and defining a continuous annulus in said well between said production tubing string and said casing between a surface end of said well and said coalbed seam, said production tubing string including a side pocket mandrel and a tubing removable gas lift valve installed in said side pocket mandrel;

installing a tubing lift gas injection line in said well annulus along with said production tubing string said lift gas injection line being connected into said side pocket mandrel to communicate into said gas lift valve;

installing a wellhead on said well having separate flow line means connecting into said production tubing string, into said well annulus, and into said lift gas injection line;

introducing compressed lift gas into said lift gas injection line and forcing said lift gas downwardly through said line and said gas lift valve into said production tubing string to displace well fluids with said lift gas upwardly in said production tubing string to said wellhead;

continuing injection of said lift gas displacing fluids from said well through said production tubing string until the bottom hole pressure in said well at said coalbed seam is at a predetermined desorption pressure at which methane gas is released from said coalbed seam into said well annulus; and producing methane gas upwardly through said annulus and outwardly from said wellhead while simultaneously gas lifting well fluids from said well through said production tubing string.

2. A method in accordance with claim 1 wherein said injection of said lift gas is continuous after said desorption pressure is reached in said well.

3. A method in accordance with claim 1 wherein injection of said lift gas into said production tubing string is intermittent after said bottom hole pressure is reduced to said desorption pressure.

4. A method in accordance with claim 1 where the production of well fluids in said production tubing string is varied by changing the volume of lift gas injected.

5. A method in accordance with claim 1 where the production of well fluids in said production tubing string is varied by changing the pressure of the lift gas injected.

6. A method in accordance with claim 1 where said well fluids include water.

* * * * *